US005495968A

United States Patent [19]

Miller

[11] Patent Number: 5,495,968

[45] Date of Patent: Mar. 5, 1996

[54] CANOE PORTAGING THWART

[76] Inventor: Ross Miller, 120 Smirle Ave., Ottawa, Canada, K1Y 0S3

[21] Appl. No.: 307,009

[22] Filed: Sep. 16, 1994

Related U.S. Application Data

[63] Continuation-in-part of Ser. No. 86,037, Jul. 6, 1993, abandoned.

[30] Foreign Application Priority Data

Jul. 28, 1992 [CA] Canada ..... 2074792

[51] Int. Cl.[6] ..... A45F 5/00

[52] U.S. Cl. ..... 224/266; 224/181; 114/364

[58] Field of Search ..... 224/266, 265, 224/255, 181; 114/364, 347

[56] References Cited

U.S. PATENT DOCUMENTS

| | | | |
|---|---|---|---|
| 2,671,231 | 3/1954 | Massicotte | 114/347 |
| 3,679,107 | 7/1972 | Perrine | 224/265 X |
| 4,649,846 | 3/1987 | Javanelle | 224/181 X |
| 4,874,120 | 10/1989 | Paton et al. | 224/266 |

FOREIGN PATENT DOCUMENTS

| | | | |
|---|---|---|---|
| 1197733 | 12/1985 | Canada | 224/266 |
| 152128 | 4/1932 | Switzerland | 114/364 |

*Primary Examiner*—Renee S. Luebke

*Attorney, Agent, or Firm*—John D. Harris; Robert A. Wilkes

[57] ABSTRACT

During the portaging of a canoe by a single canoeist, discomfort may be caused to the shoulders and neck of the canoeist. The discomfort is due both to the pressure exerted by the portaging thwart on the shoulders and neck of the canoeist and to the rotation of the canoe and hence the portaging thwart relative to the shoulders and neck during the ascent or descent of inclines. Much of the discomfort is alleviated by the present invention which provides a portaging thwart capable of axial rotation relative to a canoe. In this way, relative to the canoeist, the portaging thwart remains stationary while the canoe rotates, thereby permitting the canoeist to place the portaging thwart at the optimal angle to his or her shoulders and neck, independently of the angle of the canoe. In one embodiment of the invention, the portaging thwart is mounted in bearings attached to the gunwales of the canoe at approximately the mid point thereof. The bearings allow the portaging thwart to rotate about its axis relative to the canoe. The axial rotation of the portaging thwart in turn allows the canoe to rotate backwards and forwards relative to the canoeist, thus enabling the portaging thwart to maintain a constant position relative to the shoulders and neck of the canoeist as he or she ascends or descends sloping terrain. Stops are provided in the bearing assemblies to limit the range of rotation so that the canoe does not pivot too far during ascent, decent and while lifting the canoe, and locks are provided to prevent unwanted rotation of the yoke during storage or transport of the canoe.

11 Claims, 4 Drawing Sheets

CANOE PORTAGING THWART

This is a continuation-in-part of application Ser. No. 08/086,037 filed Jul. 6, 1993 and now abandoned.

FIELD OF THE INVENTION

The present invention relates to a canoe portaging thwart rotatable about its longitudinal axis in order to make more comfortable the portaging of a canoe by a single canoeist over both flat and undulating terrain.

BACKGROUND OF THE INVENTION

To portage a canoe, the canoe is inverted and then placed on the shoulders and neck of a canoeist. The weight of the canoe is usually transmitted to the shoulders and neck through a center thwart or other centrally located cross member.

A portaging thwart may be designed to distribute the weight of a canoe over the shoulders and neck of a canoeist in such a way as to lessen discomfort. The weight can be more evenly distributed by padding the portaging thwart or by forming the portaging thwart with a recessed portion so that it conforms somewhat with the shape of the shoulders and neck of the canoeist. However, as the conventional portaging thwart is rigidly attached to the gunwales of the canoe, the angle of the portaging thwart relative to the shoulders and neck of the canoeist cannot be adjusted to suit the individual anatomy of the canoeist.

Furthermore, the orientation of the portaging thwart on the shoulders and neck of the canoeist changes when the canoe is rotated relative to the canoeist. Such undesirable rotation occurs, for example, when the canoeist ascends or descends an incline: the body of the canoeist remains generally vertical so that the canoeist can maintain his or her balance, while the canoe is angled upwardly (during an ascent) or downwardly (during a descent) to avoid contacting the ground. The portaging thwart moves with the canoe and, as a result, the weight of the canoe may be transmitted to the shoulders and neck of the canoeist in an uncomfortable fashion, such as through pressure points.

The prior art has not solved the problem of the discomfort caused to the shoulders and neck of a canoeist due to the rotation of the portaging thwart relative to the shoulders and neck during the ascent or descent of inclines, nor does it reveal a portaging thwart the angle of which is adjustable to suit the individual anatomy of the canoeist. For instance, Canadian Patent No. 490,888 (Massicotte) teaches a canoe with a center thwart which contains two indentations, one facing the bow of the canoe and one facing the stern thereof. The indentations are designed to increase comfort during a portage by fitting around the back of the neck of a canoeist. As the indentations are on opposite sides of the thwart, the canoeist may face either the bow or the stern of the canoe.

Canadian Patent No. 948,491 (Erickson) teaches a canoe with a fixed center thwart formed to have a neck opening and a shoulder recess to increase comfort during portaging.

Canadian Patent No. 1,197,733 (Poitras) teaches a canoe with a center thwart which includes a neck recess and two adjustable shoulder supports. The shoulder supports are designed to transfer the weight of the canoe to the shoulders and neck of a canoeist in a relatively comfortable fashion.

United States Pat. No. 4,357,894 (Kirk) teaches a canoe with two thwarts oriented longitudinally rather than in the conventional transverse arrangement. The position of the thwarts on the gunwales is adjustable so that optimum weight distribution can be achieved. However, the thwarts are not suitable for portaging.

United States Pat. No. 4,873,935 (Lustig) teaches a canoe to which is rigidly attached a portaging thwart which is longitudinally oriented. The thwart contains no neck recess but is divided in two so as to accommodate the head of a canoeist.

None of the above patents offers a solution to the problem of the discomfort caused to the shoulders and neck of a canoeist due to the rotation of the portaging thwart relative to the shoulders and neck during the ascent or descent of inclines, nor does it reveal a portaging thwart the angle of which is adjustable to suit the individual anatomy of the canoeist. I have found, however, that these problems can be overcome by providing a portaging thwart capable of axial rotation relative a canoe. The result is that, relative to the canoeist, the portaging thwart remains stationary while the canoe rotates.

SUMMARY OF THE INVENTION

Accordingly, the present invention provides a canoe portaging thwart assembly comprising: an elongate rigid yoke having a central portion adapted to rest on the shoulders and neck of a canoeist, and end portions adapted to attach to opposite gunwales of a canoe such that said yoke is positioned generally perpendicularly to said gunwales; and rotation means adapted to allow said central portion of said yoke to rotate about an axis generally parallel to the longitudinal axis of said yoke, comprising a pair of bearing assemblies; wherein the range of rotation of said yoke is limited.

The present invention further provides a canoe portaging thwart assembly comprising: an elongate rigid yoke having a central portion adapted to rest on the shoulders and neck of a canoeist, and end portions adapted to attach to opposite gunwales of a canoe such that said yoke is positioned generally perpendicularly to said gunwales; and rotation means adapted to allow said central portion of said yoke to rotate about an axis generally parallel to the longitudinal axis of said yoke, wherein the range of rotation is limited by a stop means and including a lock means to selectively prevent rotation of the yoke, in combination with: a canoe to which handles are attached such that said handles may be grasped by a canoeist during the portaging of said canoe to assist in the balancing of said canoe; and a tumpline adapted to transfer a portion of the weight of said canoe during portaging from the shoulders and neck of the canoeist to his or her head, said tumpline being attached to the portaging thwart assembly and being adjustable such that the weight of said canoe can be variously distributed between the shoulders and neck of the canoeist and his or her head.

BRIEF DESCRIPTION OF THE DRAWINGS

The embodiments of the invention will now be described by way of example with reference to the accompanying drawings, in which.

DETAILED DESCRIPTION OF THE INVENTION

Figure 1:
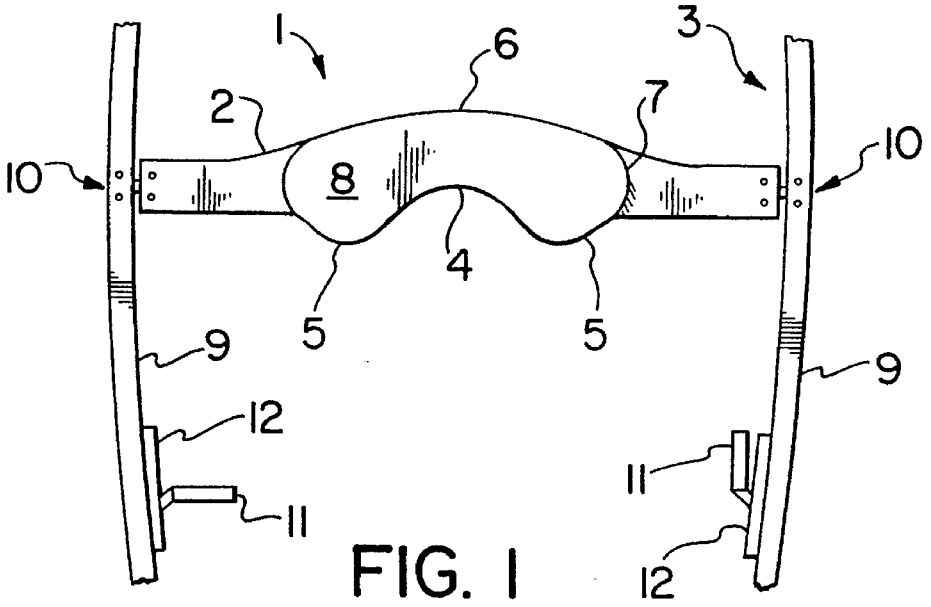
FIG. 1 is a top plan view of one embodiment of the invention.

Referring now to FIG. 1, a canoe portaging thwart assembly 1 comprises a yoke 2 which is capable of transmitting a portion of the weight of a canoe 3 to the shoulders and neck of a canoeist (not shown). The yoke 2 is formed so as to conform somewhat with the shape of the shoulders and neck of the canoeist. For example, the yoke 2 is designed with an indentation 4 to accommodate the neck of the canoeist, and with two protrusions 5 and a curvature 6 to distribute the weight of the canoe 3 over the shoulders and neck of the canoeist. Also incorporated in the yoke 2 is padding 7 which further improves the comfort of the yoke by providing a cushioning effect between the yoke 2 and the shoulders and neck of the canoeist. A relatively high coefficient of friction between the yoke 2 and the shoulders and neck of the canoeist is provided by the anti-slip surface 8 of the padding 7.

The yoke 2 is attached to two gunwales 9 of the canoe 3 by two bearing assemblies 10. The bearing assemblies 10 allow the canoe portaging thwart assembly 1 to contribute to the structural rigidity and strength of the canoe 3, while at the same time facilitating the generally limited axial rotation of the yoke 2 relative to the gunwales 9. Thus, relative to the canoeist, the yoke 2 remains substantially stationary during portaging while the canoe 3 rotates in alignment with ground contours, such as uphill or downhill slopes.

Two handles 11 are attached to the gunwales 9 of the canoe 3. When the canoe 3 is not being portaged, the handles 11 can be folded so that they are generally parallel to the gunwales 9. During a portage, however, the handles 11 can be extended so that they are generally perpendicular to the gunwales 9. In the extended position, the handles 11 can be grasped during a portage to assist the canoeist both in balancing the canoe 3 and in preventing the canoe portaging thwart assembly 1 from sliding off the shoulders and neck of the canoeist, particularly during the ascent of an incline. The position of the handles 11 can be adjusted along a mounting track 12 to accommodate canoeists with various arm lengths.

Figure 2:
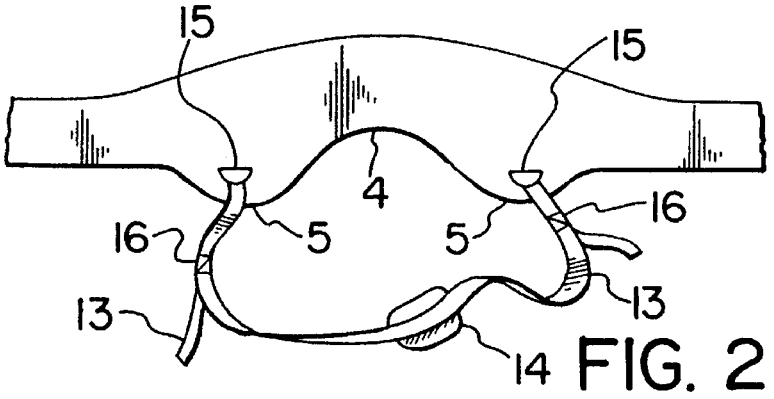
FIG. 2 is a bottom plan view of the embodiment illustrated in FIG. 1.

With reference to FIG. 2, a tumpline 13 with expanded headband 14 are attached to the yoke 2 with two D-rings 15 and two buckles 16. The tumpline 13 and expanded headband 14 serve to transfer a portion of the weight of the canoe 3 from the shoulders and neck of the canoeist to his or her head. The buckles 16 facilitate the adjustment of the length of the tumpline 13 so that the weight of the canoe 3 can be variously distributed between the shoulders and neck of the canoeist and his or her head. The shorter the length of the tumpline 13, the greater the portion of the weight of the canoe 3 is borne by the head of the canoeist.

In alternative embodiments of the invention, the tumpline 13 can be modified in various ways. For example, the tumpline can be attached to the gunwales 9 instead of the yoke 2. Similarly, the expanded headband 14 can be replaced by a hat-like head gear to which the tumpline 13 is attached.

Figure 3:
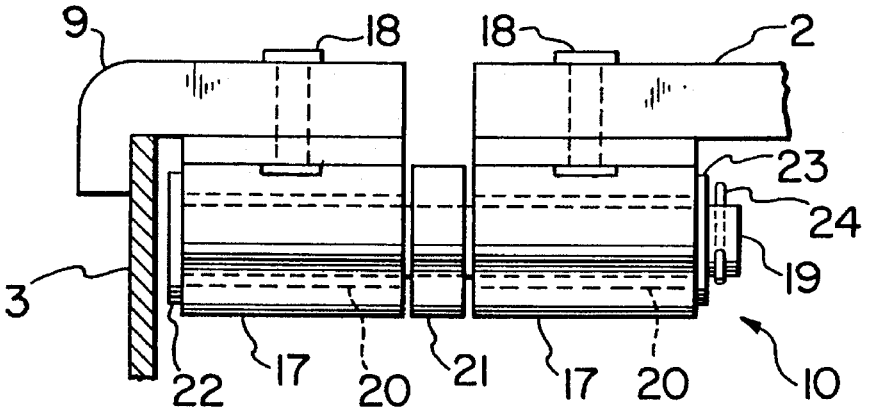
FIG. 3 is a side view of one of the bearings illustrated in FIGS. 1 and 2.
Figure 4:
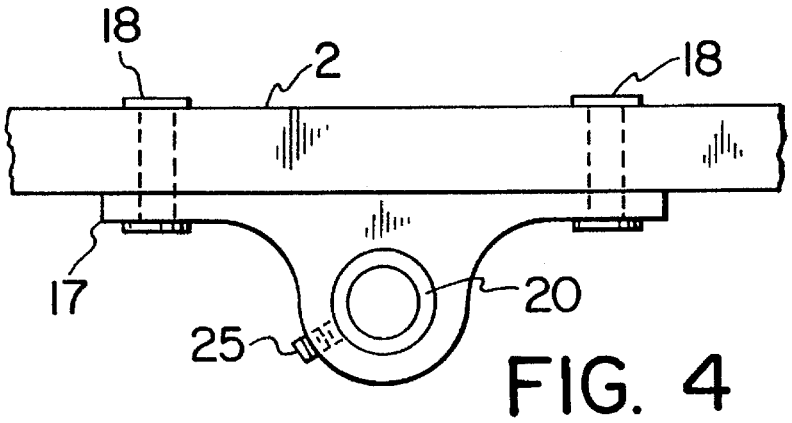
FIG. 4 is an end view of a bracket illustrated in FIG. 3.

FIGS. 3 and 4 illustrate one bearing assembly 10, which attaches the yoke 2 to a gunwale 9. Brackets 17 are attached to the yoke 2 and gunwale 9 with rivets 18. A shaft 19 passes through and rotates within the brackets 17, but contacts only the journals 20 which have a low coefficient of friction and a high resistance to wear. A spacer 21 maintains a minimum distance between the brackets 17, and a flange 22, washer 23 and cotter pin 24 maintain a maximum distance between the brackets 17, thereby allowing the canoe portaging thwart assembly 1 to contribute to the structural rigidity of the canoe 3. Screws 25 (see FIG. 4) secure the journals 20 within the brackets 17. If desired, the frictional forces between the journals 20 and the shaft 19 can be increased by tightening the screws 25. Increasing these frictional forces has two advantages. Firstly, some canoeists may find that they have better control of the canoe while it is on their shoulders and neck if there is some resistance to the free rotation of the yoke 2. Secondly, if the canoeist lifts the canoe 3 above his or her head by grasping the gunwales 9, the yoke 2 will not rotate so as to be out of position by the time the yoke 2 is placed on the shoulders and neck of the canoeist.

Figure 7:
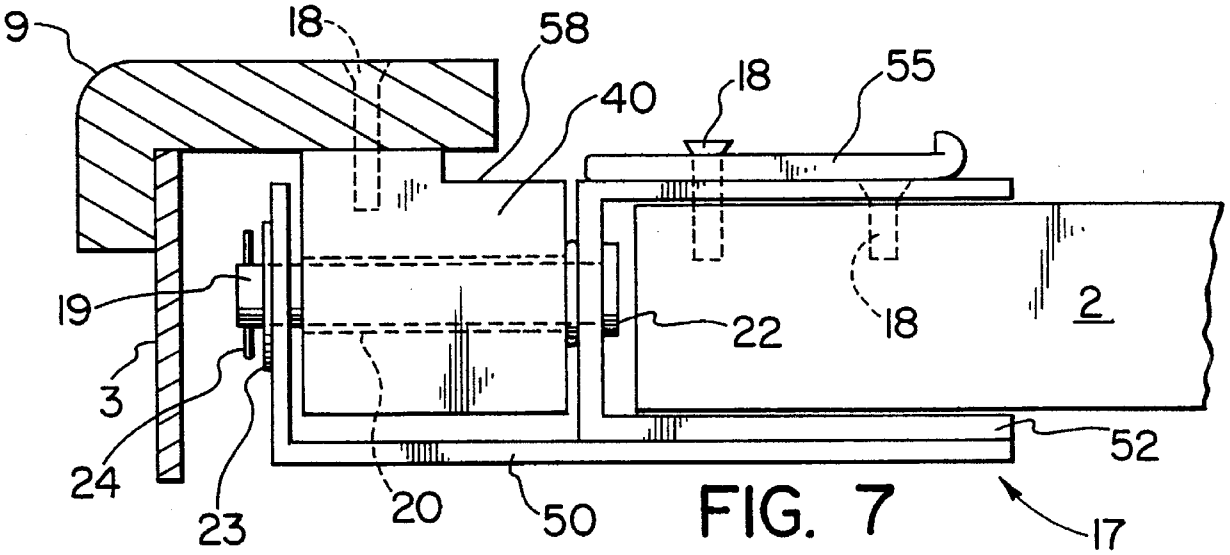
FIG. 7 is a side view of an alternative essembly of one of the bearings.
Figure 8:
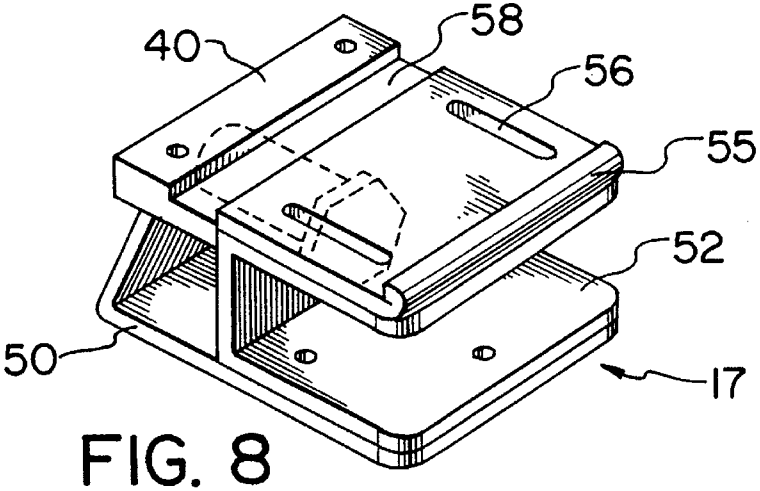
FIG. 8 is a perspective view of the bearing assembly illustrated in FIG. 7 with some parts deleted for clarity.
Figure 9:
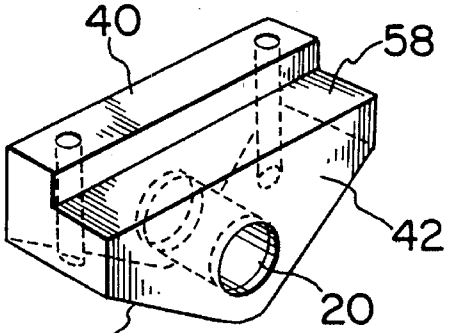
FIG. 9 is a view of the mounting block member from FIG. 7.

Another method of ensuring that the yoke 2 does not rotate to an awkward position when the canoe 3 is lifted onto the shoulders and neck of the canoeist or during ascents and decents is to limit the range of rotation of the yoke 2 by incorporating stops into the canoe portaging thwart assembly 1. As illustrated in FIGS. 7,8 and 9, stops can be incorporated into the bearing assembly 10 as a mounting block member 40 secured to the gunwale 9 having angled stop faces 42. Preferably the mounting block member 40 is generally triangular with one side fixed to the gunwale 9 and the other two sides comprising the angled stop faces 42. The shaft 19 and journal 20 are centred through the mounting block member 40 pivotally mounting the bracket 17. The bracket 17 is comprised of an L-shaped member 50 mounted on the block 40, and a U-shaped member 52 secured to the yoke 2. The stop faces 42 abut the L-shaped member 50 of the bracket 17 preventing rotation beyond a certain position.

Alternatively, the yoke 2 can be secured by a lock which can be released once the yoke 2 is resting on the shoulders and neck of the canoeist. Preferably the lock consists of a sliding plate 55 secured to the U-shaped member 52 of the bracket 17 by screws projecting through slot shaped holes 56. In a retracted position the lock rests above the U-shaped member 52. When slid to an engaged position the plate 55 projects from the U-shaped member 52 to engage a groove 58 in the mounting block 40 thus preventing the yoke 2 from rotating on the shaft 19.

Journal bearings are employed in this embodiment of the invention because they are relatively inexpensive and because their operation is unaffected by water. However, other bearings, such as ball or roller bearings, would also function well. Similarly, the position of the bearings can be changed without affecting the principle of the invention. For example, the bearings can be placed inside the yoke 2 and/or gunwales 9 rather than underneath them in order to achieve a cleaner appearance.

In the embodiments of the invention discussed above, the indentation 4 is on the bow side of the yoke 2; the canoe 3 is therefore portaged bow first. If it is desired to portage the canoe 3 stern first, the indentation 4 can instead be located on the stern side of the yoke 2. In a further embodiment of the invention, indentations 4 can be located on both the bow and stern sides of the yoke 2 to allow the canoe to be portaged in either direction.

Figure 10:
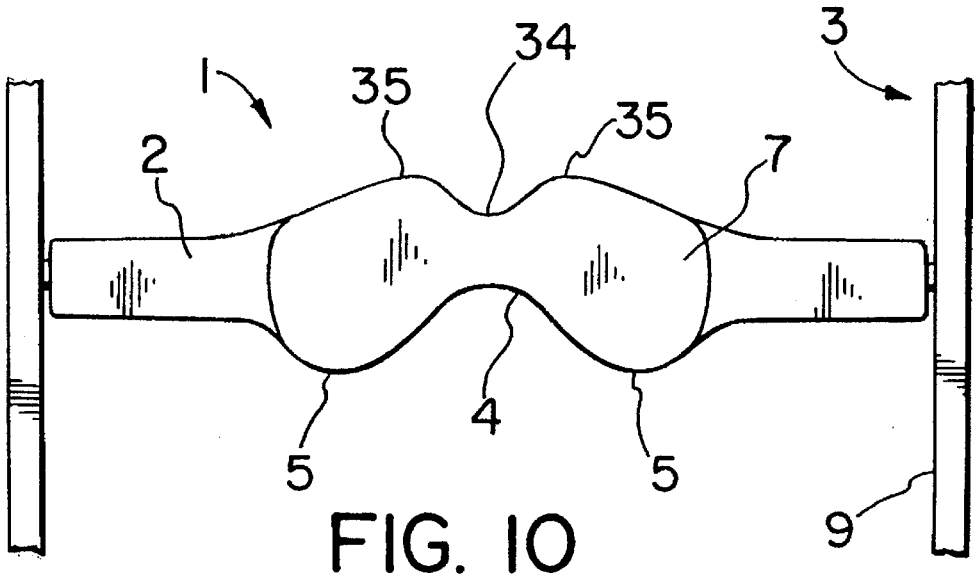
FIGS. 10 and 11 are plan views of the top and bottom of an alternative embodiment of the invention.
Figure 11:
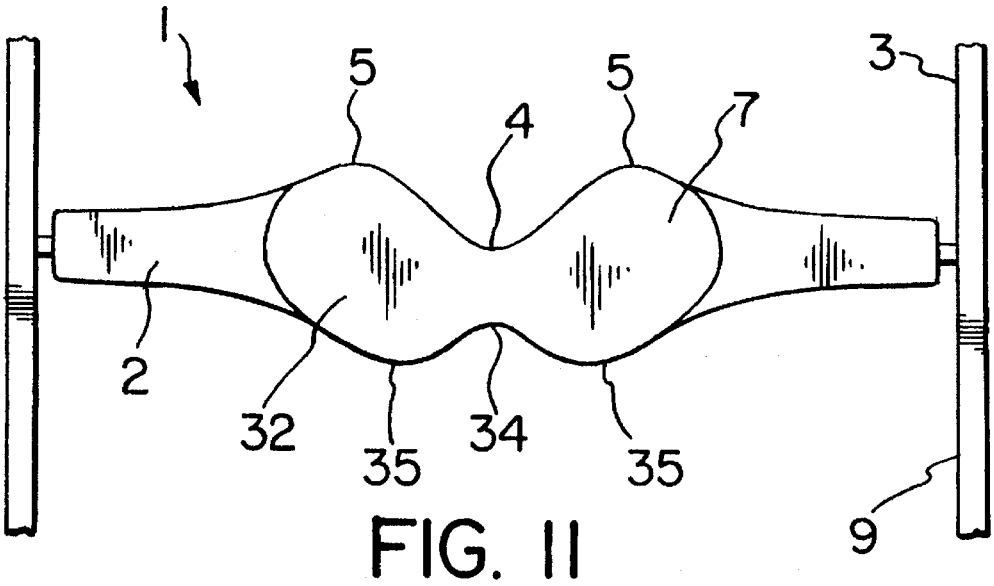
Figure 12:
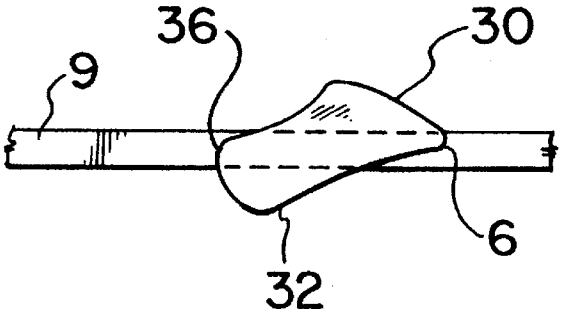
FIG. 12 is a side view of the embodiment of the invention illustrated in FIGS. 10 and 11.

In yet a further embodiment of the invention as illustrated in FIGS. 10, 11 and 12, the top 30 and bottom 32 surfaces of the yoke 2 may be differently contoured so that in one position, the yoke 2 is adapted to rest on the shoulders and neck of a canoeist of a first size range, and, in another position (say, 180 from the first position), the yoke 2 is adapted to rest on the shoulders and neck of a canoeist of a second size range.

In the yoke 2 illustrated in FIGS. 10, 11 and 12, the top surface 30 is contoured to include an indentation 4 to accommodate the neck of the canoeist, and two protrusions 5 and a curvature 6 to distribute the weight of the canoe 3 over the shoulders and neck of a canoeist of a first size range. While the bottom surface 32 is contoured to include an indentation 34 to accommodate the neck of the canoeist, and two protrusions 35 and a curvature 36 to distribute the weight of the canoe 3 over the shoulders and neck of a canoeist of a second size range.

Figure 5:
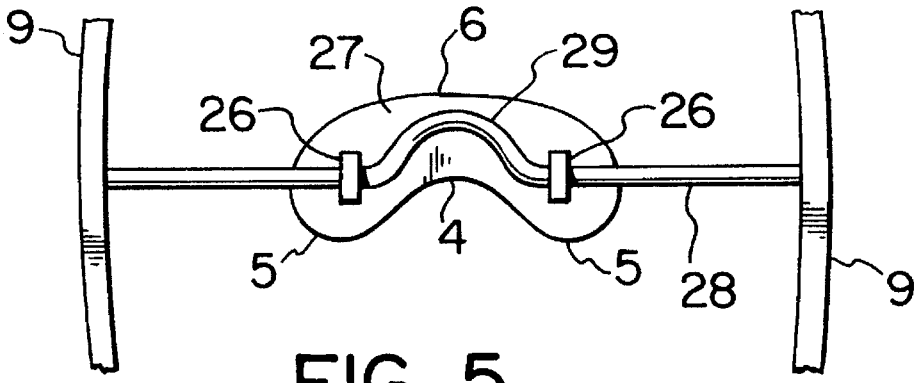
FIG. 5 is a bottom plan view of a further embodiment of the invention.
Figure 6:
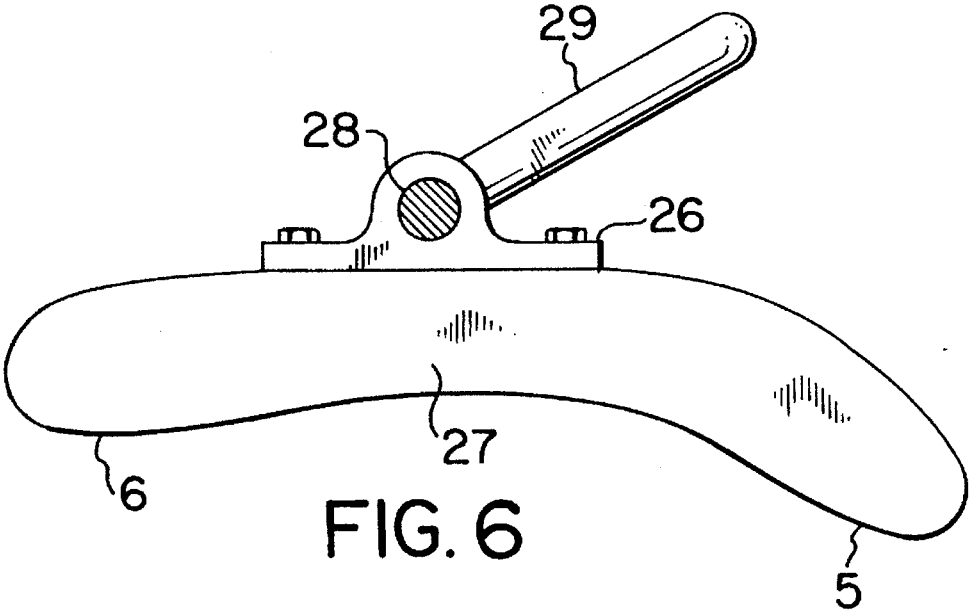
FIG. 6 is a side view of the embodiment illustrated in FIG. 5.

FIGS. 5 and 6 illustrate an embodiment wherein bearings 26 rotatably attach a shoulder block 27 to a cross member 28. The shoulder block 27 is of a design similar to the central portion of the yoke 2 described above, having, for example, an indentation 4, protrusions 5 and a curvature 6. The cross member 28, which is rigidly attached to the gunwales 9 of the canoe 3, includes a bend 29 to accommodate the neck and head of the canoeist. As can be seen from FIG. 6, the bend 29 is angled so as to permit an adequate range of rotation of the shoulder block 27 relative to the cross member 28.

I claim:

1. A canoe portaging thwart assembly comprising:

an elongate rigid yoke having a central portion adapted to rest on the shoulders and neck of a canoeist, and end portions adapted to attach to opposite gunwales of a canoe such that said yoke is positioned generally perpendicularly to said gunwales; and rotation means adapted to allow said central portion of said yoke to rotate about an axis generally perpendicular to the longitudinal axis of said yoke comprising a pair of bearing assemblies;

wherein the range of rotation of said yoke is limited.

2. A canoe portaging thwart assembly as defined in claim 1 including a lock means to selectively prevent rotation of the yoke.

3. A canoe portaging thwart assembly as defined in claim 1 wherein each of the pair of bearings assemblies is located between said end portion of said yoke and a gunwale of a canoe to which said yoke is attached.

4. A canoe portaging thwart assembly as defined in claim 1 wherein said end portions of said yoke are adapted to attach rigidly to the gunwales of a canoe, and the pair of bearings assemblies is adapted to allow said central portion of said yoke to rotate relative to said end portions of said yoke.

5. A canoe portaging thwart assembly as defined in claim 1, wherein the top and bottom surfaces of said yoke are differently contoured so that in a first rotation position said yoke is adapted to rest on the shoulders and neck of a canoeist of a first size range, and in a second rotation position said yoke is adapted to rest on the shoulders and neck of a canoeist of a second size range, said first and said second rotation positions being 180 degrees apart.

6. A canoe portaging thwart assembly as defined in claim 1, in combination with a canoe to which handles are attached such that said handles may be grasped by a canoeist during the portaging of said canoe to assist in the balancing of said canoe.

7. A canoe portaging thwart assembly as defined in claim 1, in combination with a tumpline adapted to transfer a portion of the weight of a canoe being portaged from the shoulders and neck of a canoeist to his or her head.

8. A combination as defined in claim 7 wherein said tumpline is adjustable such that the weight of the canoe being portaged can be variously distributed between the shoulders and neck of the canoeist and his or her head.

9. A canoe portaging thwart assembly as definde in claim 1 wherein the range of rotation is limited by a stop means.

10. A canoe portaging thwart assembly as defined in claim 9 wherein the stop means comprises a mounting block secured to the gunwale and having angled stop faces and a cooperating bracket pivotally mounted on the block and secured to the yoke such that the stop faces of the block abut the bracket beyond a certain rotation.

11. A canoe portaging thwart assembly as defined in claim 10 including a releasable lock means slidable from a first free position on the yoke to a second locked position engaging the block to selectively prevent rotation of the yoke with respect to the block.

* * * * *